US011357381B2

(12) United States Patent
Ko et al.

(10) Patent No.: US 11,357,381 B2
(45) Date of Patent: Jun. 14, 2022

(54) NOZZLE FOR CLEANER

(71) Applicant: LG Electronics Inc., Seoul (KR)

(72) Inventors: Moohyun Ko, Seoul (KR); Namil Woo, Seoul (KR); Daeho Chang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 635 days.

(21) Appl. No.: 16/389,399

(22) Filed: Apr. 19, 2019

(65) Prior Publication Data

US 2019/0328200 A1 Oct. 31, 2019

(30) Foreign Application Priority Data

Apr. 30, 2018 (KR) ..... 10-2018-0050043

(51) Int. Cl.

| | |
|---|---|
| ***A47L 13/22*** | (2006.01) |
| ***A47L 9/02*** | (2006.01) |
| ***A47L 11/16*** | (2006.01) |
| ***A47L 11/202*** | (2006.01) |

(52) U.S. Cl.

CPC ..... *A47L 13/22* (2013.01); *A47L 9/02* (2013.01); *A47L 11/161* (2013.01); *A47L 11/2025* (2013.01)

(58) Field of Classification Search

CPC ..... A47L 13/22; A47L 9/02; A47L 11/161; A47L 11/2025; A47L 11/305; A47L 11/4088; A47L 11/283; A47L 11/408

See application file for complete search history.

(56) References Cited

U.S. PATENT DOCUMENTS

| | | | |
|---|---|---|---|
| 7,640,626 | B2 | 1/2010 | Oh |
| 10,582,826 | B2 | 3/2020 | Hwang et al. |
| 2017/0202416 | A1 | 7/2017 | Hwang et al. |

FOREIGN PATENT DOCUMENTS

| | | | |
|---|---|---|---|
| KR | 10-1014468 | B1 | 2/2011 |
| KR | 10-1408733 | B1 | 6/2014 |
| KR | 10-1595727 | | 2/2016 |
| KR | 10-1769232 | B1 | 6/2017 |
| KR | 10-2008-0020304 | A | 3/2018 |
| WO | WO 2011/059120 | | 5/2011 |

*Primary Examiner* — David Redding

(74) *Attorney, Agent, or Firm* — Birch, Stewart, Kolasch & Birch, LLP

(57) ABSTRACT

A nozzle for a cleaner includes a nozzle body having a suction passage in which air flows. A water tank is detachably mounted on the nozzle body, and a rotation cleaning part is rotatably supported at a lower side of the nozzle body to receive water from the water tank for cleaning a floor. The water tank includes an outlet through which water is discharged, a valve configured to open and close the outlet, and an air hole configured to introduce outside air into the water tank. An air hole operation part is movably installed on the water tank to open and close the air hole.

15 Claims, 11 Drawing Sheets

NOZZLE FOR CLEANER

CROSS-REFERENCE TO RELATED APPLICATION

This application is based on and claims the benefit of priority to Korean Patent Application No. 10-2018-0050043, filed on Apr. 30, 2018, in the Korean Intellectual Property Office, the disclosure of which is incorporated herein in its entirety by reference.

FIELD

The present specification relates to a nozzle for a cleaner.

BACKGROUND

A cleaner is a device for suctioning in or wiping dust or foreign materials in an area to be cleaned.

Such a cleaner may be divided into a manual cleaner for performing cleaning while a user directly moves the cleaner and an automatic cleaner for performing cleaning while autonomously traveling.

In addition, the manual cleaner may be divided into a canister-type cleaner, an upright-type cleaner, a handy-type cleaner and a stick-type cleaner, according to the shape of the cleaner.

Such a cleaner may clean a floor using a nozzle. In general, the nozzle may be used to suction in air and dust. According to the type of the nozzle, a mop may be attached to a nozzle to wipe a floor.

In the related art, Korean Patent Registration No. 10-0405244 discloses a suction port assembly for a vacuum cleaner.

The suction port assembly of the related art includes a suction body provided with a suction port.

The suction body includes a first suction path located at the front side thereof, a second suction path located at the rear side thereof, and a guide passage formed between the first suction path and the second suction path.

A mop is rotatably provided on a lower end of the suction body and a rotation driving part for driving the mop is provided inside the suction body.

However, in the related art, since a structure for supplying water to the mop is not provided, when a user wants to perform cleaning using the mop with water, the user needs to directly supply water to the mop.

SUMMARY

Embodiments provide a nozzle for a cleaner capable of not only suctioning in foreign materials on a floor but also rotating a mop to wipe the floor and supplying water to the mop.

Embodiments provide a nozzle for a cleaner capable of controlling the amount of water supplied to a mop.

In one embodiment, a nozzle for a cleaner includes a nozzle body including a suction passage in which air flows, a water tank detachably mounted in the nozzle body, and a rotation cleaning part rotatably provided at a lower side of the nozzle body to receive water of the water tank and to clean a floor. The water tank includes an outlet, through which water is discharged, a valve configured to open and close the outlet, an air hole configured to introduce outside air into the water tank, and an air hole operation part movably provided on the water tank to open and close the air hole.

The nozzle body may include a valve operation part configured to operate the valve to open the outlet in a process of mounting the water tank in the nozzle body, and When the air hole is opened by operating the air hole operation part in a state in which the valve opens the outlet, water of the water tank may be discharged through the outlet.

The water tank may include a plurality of air holes, and the air hole operation part may open some or all of the plurality of air holes according to an operation position of the air hole operation part.

The water tank may include a plurality of air holes having different sizes, and the air hole operation part may selectively open the plurality of air holes according to an operation position of the air hole operation part.

For example, some of the plurality of air holes may be opened when the air hole operation part moves in a first direction and the others of the plurality of air holes may be opened when the air hole operation part moves in a direction opposite to the first direction.

In another example, some of the plurality of air holes may be opened when the air hole operation part moves in a first direction and all of the plurality of air holes may be opened when the air hole operation part further moves in the first direction.

The water tank may be coupled with a gasket including the air hole, and an air passage, in which air flows, may be formed in the gasket. A portion where the air hole is formed in the gasket is located inside the water tank.

The gasket may be formed such that a cross-sectional area thereof decreases from one point to the portion where the air hole is formed.

A shape of the gasket may be able to be changed by external force, and, when an outer shape of the gasket is deformed by operation of the air hole operation part, outside air may be introduced into the water tank through the air passage and the air hole.

The air hole may include a first air hole and a second air hole formed at a higher position with respect to gravity than the first air hole. The air hole operation part may open and close the first air hole, and the water tank may further include an air passage configured to enable communication between the first air hole and the second air hole.

The water tank may include a tank body forming a chamber in which water is stored. The tank body may form the air passage, and the air passage may be covered by a body cover.

The first air hole may be formed in the body cover and the second air hole may be formed in the tank body.

The air hole operation part may be provided on the body cover.

The first air hole may be located at a lower position relative to gravity than a full water level of the water tank. The second air hole may be located at a higher position relative to gravity than a full water level of the water tank.

The first air hole and the second air hole may be spaced apart from each other in a forward-and-backward direction.

DETAILED DESCRIPTION OF THE EMBODIMENTS

Figure 1:
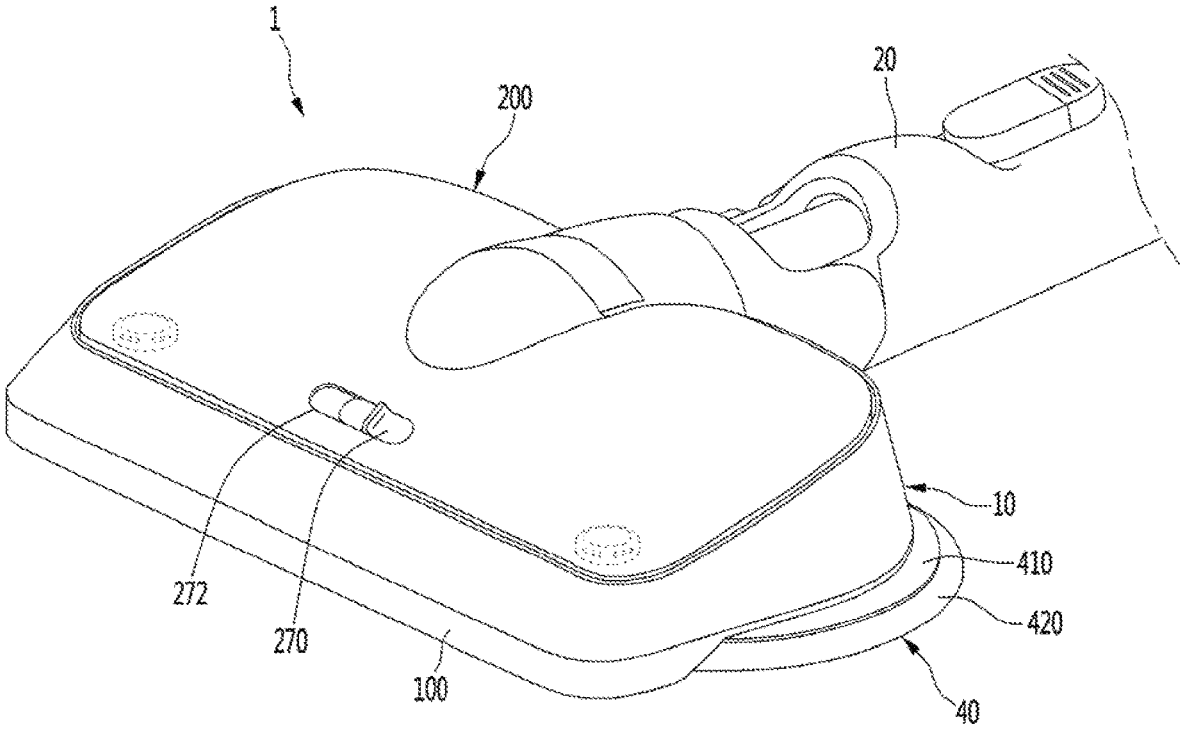
FIG. 1 is a perspective view of a nozzle for a cleaner according to a first embodiment of the present invention.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
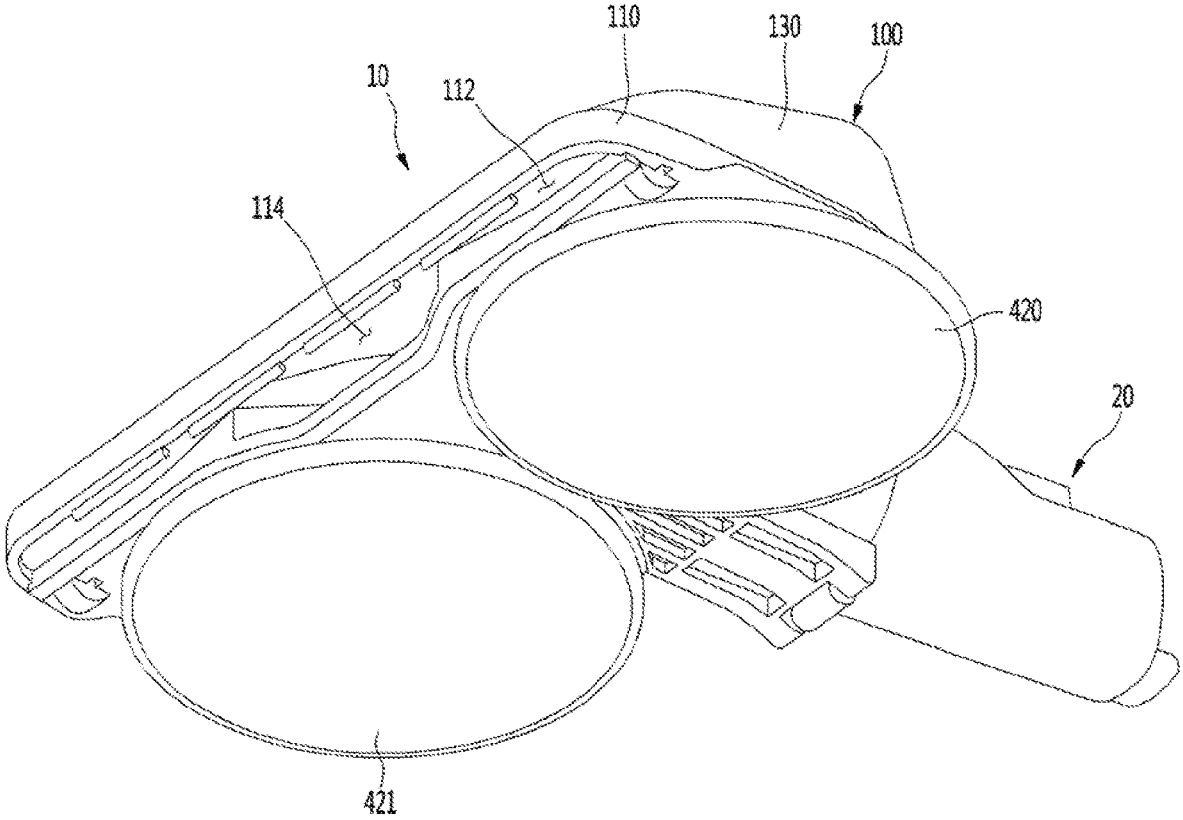
FIG. 2 is a perspective view of the nozzle for the cleaner of FIG. 1 when viewed from the lower side thereof.
Figure 3:
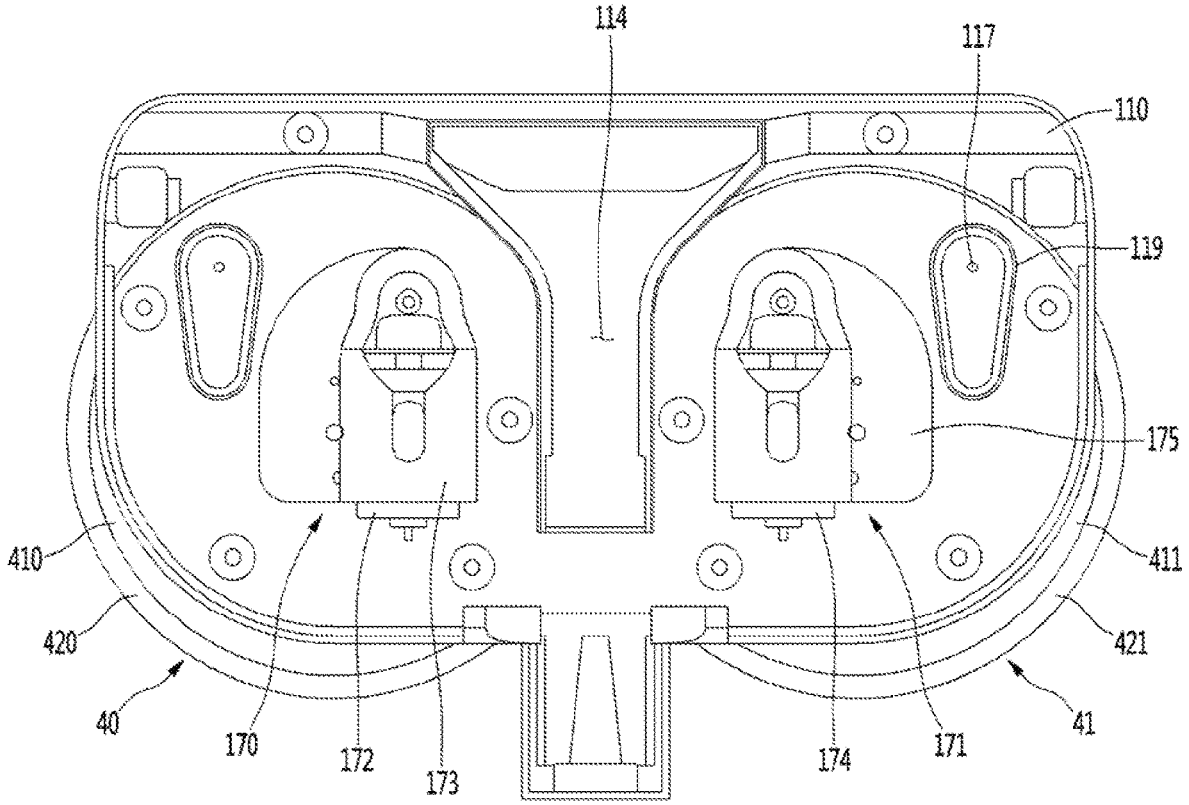
FIG. 3 is a view showing arrangement of a driving device in the nozzle according to the first embodiment of the present invention.

FIG. 1 is a perspective view of a nozzle for a cleaner according to a first embodiment of the present invention, FIG. 2 is a perspective view of the nozzle for the cleaner of FIG. 1 when viewed from the lower side thereof, and FIG. 3 is a view showing arrangement of a driving device in the nozzle according to the first embodiment of the present invention.

Referring to FIGS. 1 to 3, the nozzle 1 for the cleaner (hereinafter referred to as a "nozzle") according to the embodiment of the present invention may comprise a nozzle body 10 and a connection pipe 20 movably connected to the nozzle body 10.

The nozzle 1 of the present embodiment may be used in a state of being connected to a handy-type cleaner or a canister-type cleaner, for example.

The nozzle 1 may comprise a battery therein to supply power to a power consumption part or may operate by receiving power from the connected cleaner.

Since the cleaner connected to the nozzle 1 comprises a suction motor, suction force generated by the suction motor may be applied to the nozzle 1 to suction in foreign materials and air on a floor through the nozzle 1.

Accordingly, in the present embodiment, the nozzle 1 may serve to suction and guide foreign materials and dust on the floor to the cleaner.

The connection pipe 20 may be connected to the center of the rear side of the nozzle body 10 to guide the suctioned air to the cleaner, without being limited thereto. The connection pipe 20 may be connected to the suction pipe of the cleaner.

The nozzle 1 may further comprise rotation cleaning parts 40 and 41 rotatably provided at the lower side of the nozzle body 10.

For example, a pair of rotation cleaning parts 40 and are arranged from side to side. The pair of rotation cleaning parts 40 and 41 may independently rotate. For example, the nozzle 1 may comprise the first rotation cleaning part 40 and the second rotation cleaning part 41. In the present embodiment, the nozzle 1 may comprise one rotation cleaning part.

The rotation cleaning parts 40 and 41 may comprise mops 420 and 421 and rotation plates 410 and 411 attached with the mops 420 and 421 to rotate, respectively.

For example, the mops 420 and 421 may comprise the first mop 420 and the second mop 421. The first mop 420 and the second mop 421 may be arranged from side to side.

The rotation plates 410 and 411 may comprise the first rotation plate 410 attached with the first mop 420 and the second rotation plate 411 attached with the second mop 421.

The first rotation plate 410 and the second rotation plate 411 may be arranged from side to side.

The rotation plates 410 and 411 may be formed in a disk shape, for example, and may be attached with the mops 420 and 421.

The nozzle body 10 may comprise a nozzle housing 100 forming appearance thereof. The nozzle housing 100 may comprise suction passages 112 and 114 for suctioning in air.

The suction passages 112 and 114 may comprise a first passage 112 extending from the nozzle housing 100 in the left-and-right direction and a second passage 114 communicating with the first passage 112 and extending in a forward-and-backward direction.

The first passage 112 may be formed in the front end of the lower surface of the nozzle housing 100, for example.

The second passage 114 may extend backward from the first passage 112. For example, the second passage 114 may extend backward from the center of the first passage 112 toward the connection pipe 20.

The nozzle housing 100 may comprise a nozzle base 110 and a nozzle cover 130 coupled to an upper side of the nozzle base 110.

The nozzle base 110 may define the first passage 112. A passage forming part (not shown) forming the second passage 112 with the nozzle base 110 may be coupled to the upper side of the nozzle base 110.

The nozzle body 10 may further comprise a water tank 200 to supply water to the mops 420 and 421.

The water tank 200 may be detachably connected to the nozzle housing 100. In a state in which the water tank 200 is mounted on the nozzle housing 100, water of the water tank 200 may be supplied to the mops 420 and 421.

The water tank 200 may comprise an air hole operation part 270 operated by a user to discharge water from the water tank 200. When the air hole operation part 270 is operated in one direction, water may be discharged from the water tank 200, and, when the air hole operation part 270 is operated in the other direction, discharging of water from the water tank 200 may be stopped. The air hole operation part 270 may be located at a lower position relative to gravity than a maximum water level of the water tank 200.

In order to rotate the rotation plates 410 and 411, the nozzle body 10 may further comprise a driving device.

The driving device may comprise a first driving device 170 for rotating the first rotation plate 410 and a second driving device 171 for rotating the second rotation plate 411.

The driving devices 170 and 171 may be provided at the upper side of the nozzle base 110 may be spaced apart from each other in the left-and-right direction.

The second passage 114 may be located between the first driving device 170 and the second driving device 171.

The driving devices 170 and 171 may comprise driving motors 172 and 174 and motor housings 173 and 175 respectively accommodating the driving motors 172 and 174, respectively.

A plurality of gears for transmitting power of the driving motors 172 and 174 to the rotation plates 410 and 411 may be provided inside the motor housings 173 and 175. The last gear of the plurality of gears may be connected to the rotation plates 410 and 411.

A water passage hole 117, through which water discharged from the water tank 200 passes, may be formed in the nozzle base 110. A blocking rib 119 for preventing water discharged from the water tank 200 toward the driving devices 170 and 171 before passing through the water passage hole 117 may be formed in the nozzle base 110.

The blocking rib 119 may be formed in a closed loop shape, for example, and the water passage hole 117 may be located in an area in which the blocking rib 119 is formed.

Figure 4:
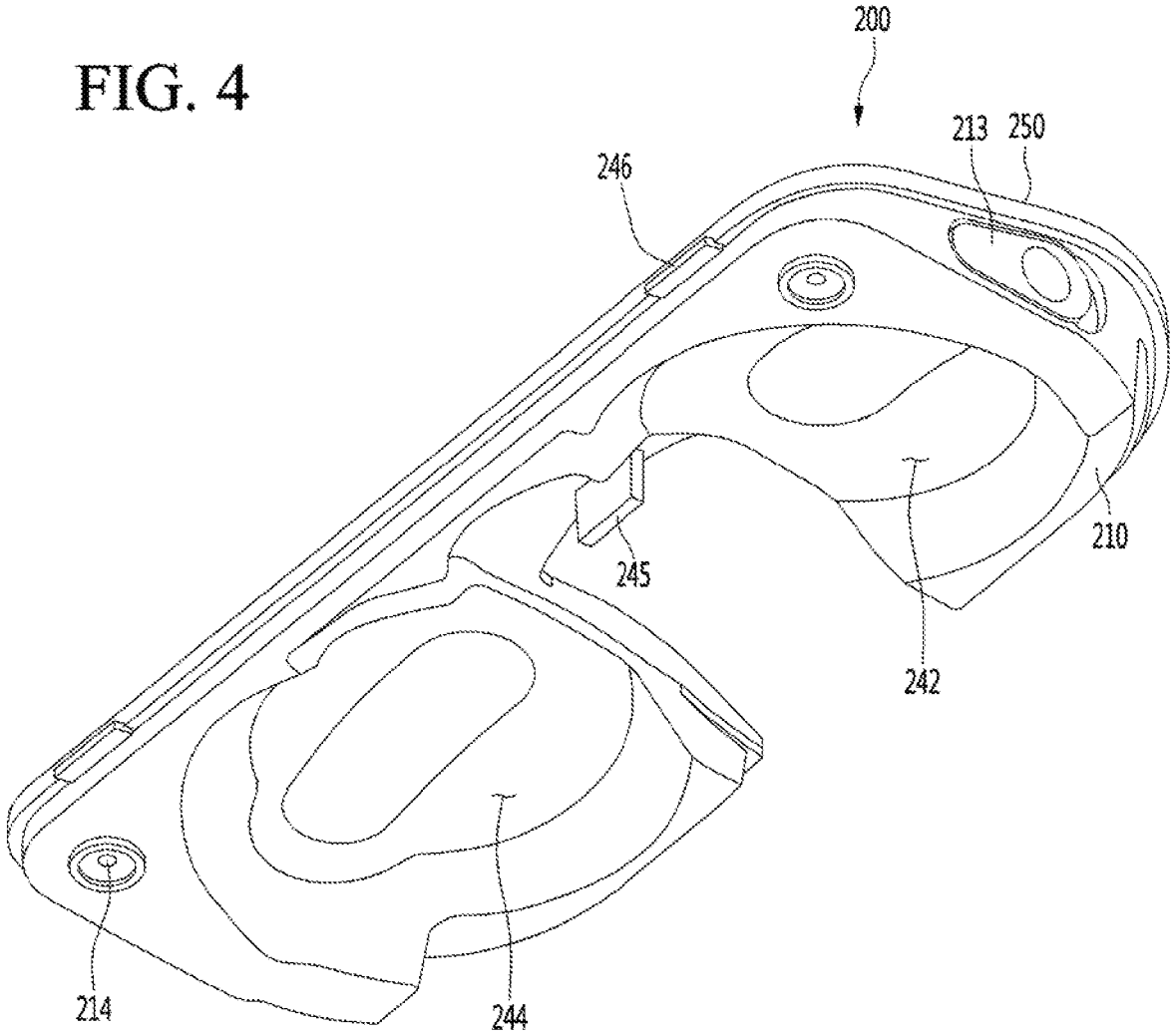
FIG. 4 is a view showing a water tank according to the first embodiment of the present invention when viewed from the lower side thereof.
Figure 5:
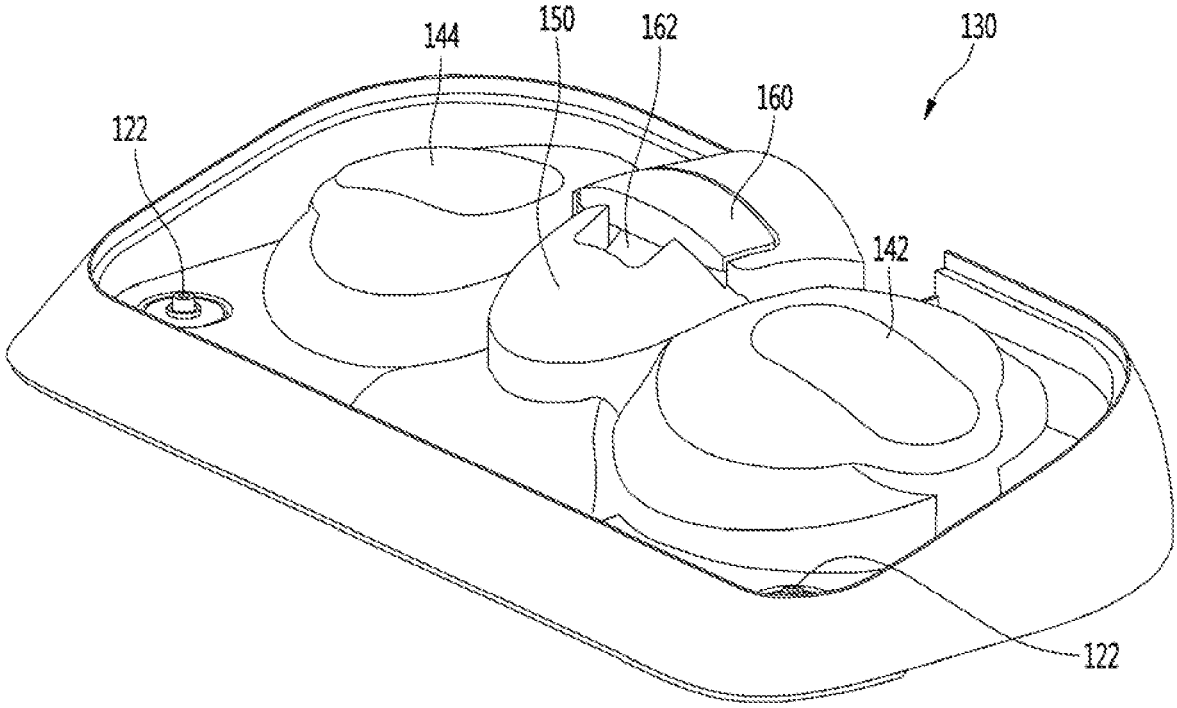
FIG. 5 is a perspective view of a nozzle cover according to the first embodiment of the present invention.

FIG. 4 is a view showing a water tank according to the first embodiment of the present invention when viewed from the lower side thereof, and FIG. 5 is a perspective view of a nozzle cover according to the first embodiment of the present invention.

Referring to FIGS. 1 to 5, the water tank 200 may be mounted at the upper side of the nozzle housing 100.

For example, the water tank 200 may be seated on an upper side of the nozzle cover 130. In a state in which the water tank 200 is seated on the nozzle cover 130, the water tank 200 may define a portion of the appearance of the nozzle body 10.

The water tank 200 may comprise a tank body defining a chamber in which water is stored. The tank body may be formed such that the front side thereof has a low height and the rear side thereof has a high height.

The rear side of the tank body is located adjacent to the connection pipe 20. In this case, the front side of the nozzle 1 may have a low height and the rear side thereof may have a high height. When the height of the front side of the nozzle 1 is low, the nozzle may enter a narrow gap, thereby increasing a cleanable region.

The tank body may comprise a first body 210 and a second body 250 coupled to the first body 210 to define the chamber with the first body 210.

The water tank 200 may further comprise an inlet (not shown) for introducing water into the chamber and an inlet cover 213 covering the inlet.

The water tank 200 may further comprise an outlet 214 for discharging water. For example, the water tank 200 may comprise a plurality of outlets 214 to supply water to the rotation cleaning parts 40 and 41. The plurality of outlets 214 may be spaced apart from each other in the left-and-right direction.

The outlets 214 may be opened and closed by the valve (see 230 of FIG. 6) located inside the water tank 200.

The water tank 200 may further comprise a first coupling part 245 for coupling with the nozzle body 10.

In addition, the water tank 200 may further comprise a coupling rib 246 coupled with the nozzle body 10 before the first coupling part 245 is coupled to the nozzle body 10.

The nozzle cover 130 may comprise driving-part covers 142 and 144 that is configured to cover the upper sides of the driving devices 170 and 171.

The driving-part covers 142 and 144 are portions protruding upward from the nozzle cover 130. The driving-part covers 142 and 144 may surround the upper sides of the driving devices 170 and 171 provided in the nozzle base 110.

The water tank 200 may comprise receiving spaces 242 and 244 in which the driving-part covers 142 and 144 are received in a state in which the water tank 200 is mounted in the nozzle body 10. The receiving spaces 242 and 244 may be formed by depressing a portion of the water tank 200 upward.

In addition, when the water tank 200 is seated on the nozzle cover 130, the driving-part covers 142 and 144 are respectively received in the receiving spaces 242 and 244, thereby preventing interference between components.

When the water tank 200 is mounted in the nozzle body 10, the water tank 200 surrounds the driving-part covers 142 and 144. Accordingly, by the water tank 200, it is possible to increase the storage capacity of water in the water tank 200 while minimizing increase in height of the nozzle 1.

The nozzle cover 130 may further comprise a button support part 150 that is configured to support an operation button 160 operated by the user in order to detach the water tank 200 from the nozzle body 10.

The button support part 150 is disposed between the driving-part covers 142 and 144 and is located above the second passage 114.

In the button support part 150, a second coupling part 162 for coupling with the first coupling part 245 of the water tank 200 may be provided below the operation button 160.

When the operation button 160 is operated in a state in which the first coupling part 245 is coupled to the second coupling part 162, the second coupling part 162 may be decoupled and spaced apart from the first coupling part 245.

The nozzle cover 130 may further comprise a valve operation part 122 for operating the valve 230 while the water tank 200 is seated.

The valve operation part 122 may protrude upward from the nozzle cover 130 and have a passage therein.

Figure 6:
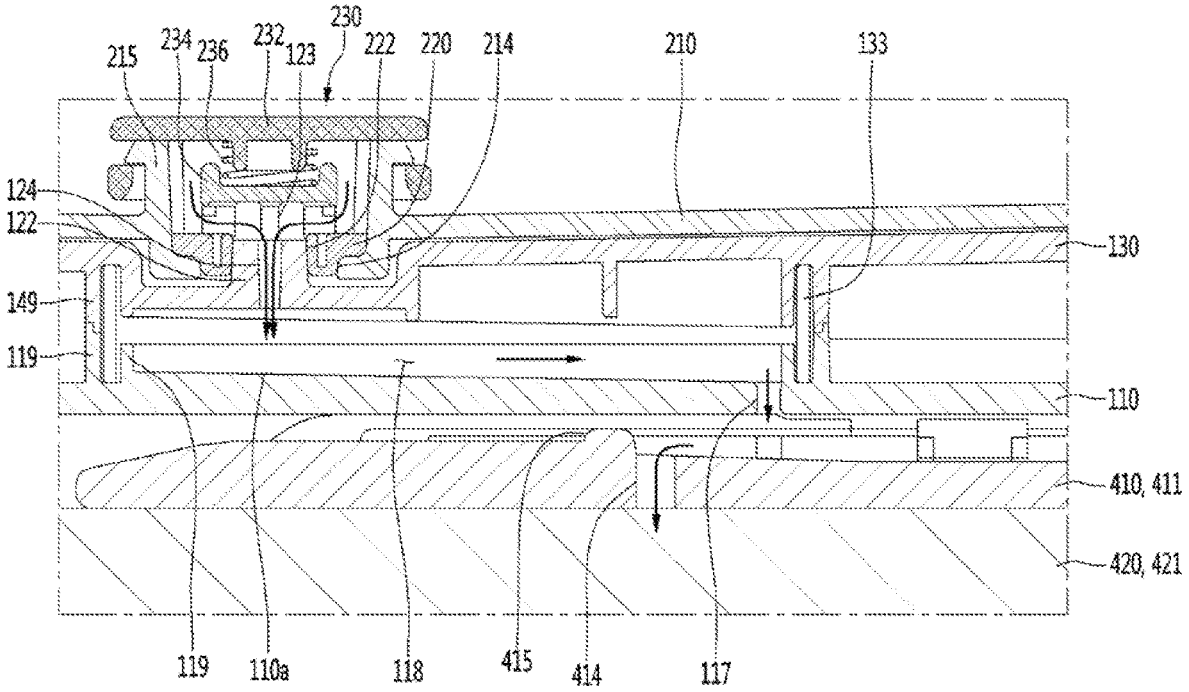
FIG. 6 is a cross-sectional view showing a state in which a valve opens an outlet in a state in which a water tank is mounted in a nozzle body.

FIG. 6 is a cross-sectional view showing a state in which a valve opens an outlet in a state in which a water tank is mounted in a nozzle body.

Referring to FIG. 6, the valve 230 may comprise an opening/closing part 234 and a fixing part 232.

The fixing part 232 may be fixed to a fixing rib 215 protruding upward from the first housing 210.

The fixing part 232 restricts movement of the opening/closing part 234 to a certain height in a state of being coupled to the fixing rib 215.

The opening/closing part 234 may move upward and downward and open the outlet 214 while moving upward.

The opening/closing part 234 may be elastically supported by an elastic member 236. The elastic member 263 is a coil spring, for example, one end thereof is supported by the fixing part 232 and the other end thereof is supported by the opening/closing part 234.

The elastic member 236 applies force to the opening/closing part 234 such that the opening/closing part 234 moves downward.

The diameter of at least a portion of the opening/closing part 234 may be greater than that of the outlet 214, thereby preventing the opening/closing part 234 from blocking the discharge part 214.

Alternatively, a packing part 220 made of rubber may be coupled to the outlet 214 and an opening 222 may be formed in the packing part 220. The opening/closing part 234 may open or close the opening 222.

The valve operation part 122 may enter the water tank 200 through the opening 222 of the packing part 220, when the water tank 200 is mounted in the nozzle body 10.

When the valve operation part 122 passes through the opening 222 of the packing part 220, the valve operation part 122 raises the opening/closing part 234. Then, the opening/closing part 234 is spaced apart from the opening 222.

The valve operation part 122 may be formed in a cylindrical shape, for example. A water passage 124 may be formed inside the valve operation part 122 and one or more slots 123 may be formed in the circumference of the valve operation part.

Accordingly, water in the water tank 200 flows into the water passage 214 through the slots 123 and flow downward along the water passage 214.

Meanwhile, a blocking rib 149 may be provided on the nozzle cover 130 at a position corresponding to the blocking rib 119 of the nozzle base 110.

The blocking rib 149 of the nozzle cover 130 may be seated on the blocking rib 119 of the nozzle base 110. The blocking ribs 119 and 149 form a guide passage 118 in which water discharged from the water tank 200 flows.

A sealing member 133 may be provided in inner areas of the blocking ribs 119 and 149 such that water of the guide passage 118 is not leaked. The sealing member 133 may prevent water from being leaked through a contact surface of the blocking ribs 119 and 149.

At this time, the valve operation part 122 and the water passage hole 117 of the nozzle base 110 are disposed not to overlap in an upward-and-downward direction.

Accordingly, water passing through the valve operation part 122 may drop onto the upper surface 110*a* of the nozzle base 110 and then flow toward the water passage hole 117.

At this time, the upper surface 110*a* may be inclined downward toward the water passage hole 117 at a point where water drops, such that water dropping onto the upper surface 110*a* of the nozzle base 110 smoothly flows toward the water passage hole 117.

Alternatively, the guide passage 118 may be provided with an absorption part (not shown) for absorbing water. The absorption part may absorb water discharged from the water tank 200. When the amount of supplied water increases, water of the absorption part may drop toward the water passage hole 117.

When the amount of water in the water tank 200 is large, water is smoothly supplied to the mop by water pressure of water discharged from the water tank 200. However, when the amount of water decreases, water pressure is weak and thus the amount of water decreases. The absorption part may serve as a damper for continuously supplying water to the mop during the cleaning process.

The rotation plates 410 and 411 may comprise openings 414, through which water discharged from the water passage hole 117 passes.

Since the rotation plates 410 and 411 rotate, a plurality of openings 414 may be spaced apart from each other in a circumferential direction, such that water smoothly passes through the openings 414.

The openings 414 may be located outside the water passage hole 117 in a radial direction. When centrifugal force is generated when the rotation plates 410 and 411 rotate, water moves by centrifugal force outward in the radial direction.

Accordingly, when the openings 414 are located outside the water passage hole 117 in the radial direction, water passing through the water passage hole 117 may easily move to the openings 414.

A water blocking rib 415 may be formed on the upper surfaces of the rotation plates 410 and 410 outside the openings 414 in the radial direction. The water blocking rib 415 may be consecutively formed in a circumferential direction. That is, each of the plurality of openings 414 may be located in the inner areas of the water blocking rib 415.

By the water blocking rib 415, water passing through the water passage hole 117 may be prevented from flowing to the outside without passing through the openings 414.

Figure 7A:
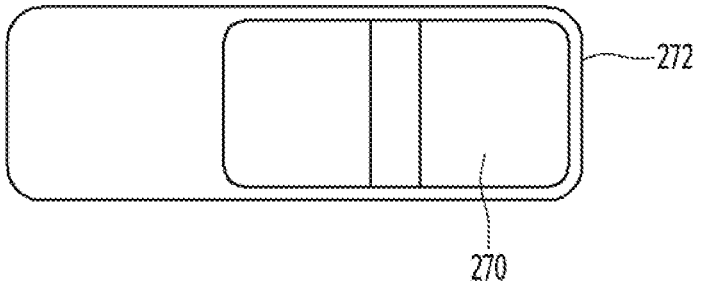
FIGS. 7A-7C are views showing a process of opening and closing an air hole by an air hole operation part according to the first embodiment of the present invention.
Figure 7B:
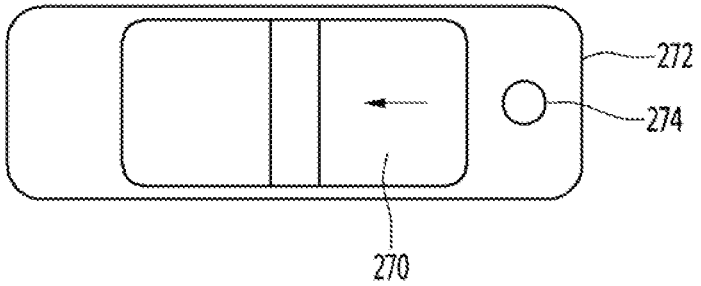
Figure 7C:
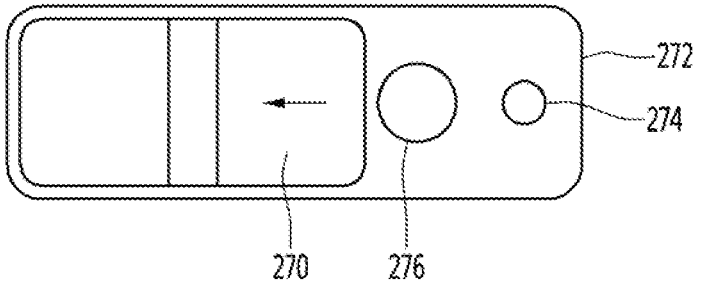

FIGS. 7A-7C are views showing a process of opening and closing an air hole by an operation part according to the first embodiment of the present invention.

FIG. 7A is a view showing a state in which the operation part closes the air hole, FIG. 7B is a view showing a state in which the operation part opens the first air hole, and FIG. 7C is a view showing a state in which the operation part opens the first air hole and the second air hole.

Referring to FIGS. 7A-7C, in order to discharge water of the water tank 200 to the outside in a state in which water is stored in the water tank 200, the pressure of the internal space of the water tank 200 should be equal or similar to atmospheric pressure.

In the present embodiment, even when the valve operation part 122 operates the valve 230 of the water tank 200 to supply water to the water tank 200, the internal space of the water tank 200 cannot communicate with the external space and thus water is not discharged.

Accordingly, in the present embodiment, one or more air holes 274 and 276 for introducing outside air may be formed in the water tank 200. Hereinafter, assume that two air holes 274 and 276 may be formed in the water tank 200.

The water tank 200 may comprise an installation part 272 in which the air hole operation part 270 is movably installed. The air hole operation part 270 may be slidably located in the installation part 272, for example. Alternatively, the air hole operation part 270 may be rotatably configured.

In addition, the air holes 274 and 276 may be opened or closed according to the position of the air hole operation part 270.

As shown in FIG. 7A, in a state in which the air hole operation part 270 moves to a first position, the air hole operation part 270 closes the air holes 274 and 276. In this state, water is not discharged from the water tank 200.

In order to supply water to the mops 420 and 421 before cleaning or during cleaning, the air hole operation part 270 operates to move to a second position as shown in FIG. 7B. Then, the first air hole 274 may be opened.

When the first air hole 274 is opened, the internal space of the water tank 200 may be in the atmospheric pressure state, thereby discharging water from the water tank 200.

Since water is continuously discharged from the water tank 200 in a state in which the first air hole 274 is opened, water may be stably supplied to the mops 420 and 421.

In order to increase the amount of water discharged from the water tank 200, the air hole operation part 270 may move to a third position as shown in FIG. 7C. Then, not only the first air hole 274 but also the second air hole 276 may be opened, thereby increasing the amount of air introduced into the water tank 200 and increasing the amount of water discharged from the water tank 200.

The size of the second air hole 276 may be less than, equal to or greater than that of the first air hole 274.

In order to discharge water from the water tank 200, the diameter of the first air hole 274 may be 1.5 mm or more, without being limited thereto.

As another example, the air hole operation part 270 may be configured to selectively open two air holes having different sizes. For example, the two air holes are closed when the air hole operation part 270 is at a neutral position, any one of the two air holes may be opened when the air hole operation part 270 moves to the first position, and the other of the two air holes may be opened when the air hole operation part 270 moves to the second position.

According to the present embodiment, it is possible to suction in foreign materials on the floor and to rotate the mops to wipe the floor.

In particular, since the nozzle comprises the water tank and water of the water tank can be continuously supplied to the mops by operating the operation part, it is possible to improve user convenience.

In addition, since the amount of water discharged from the water tank can be controlled by operating the operation part, it is possible to further improve user convenience.

Figure 8:
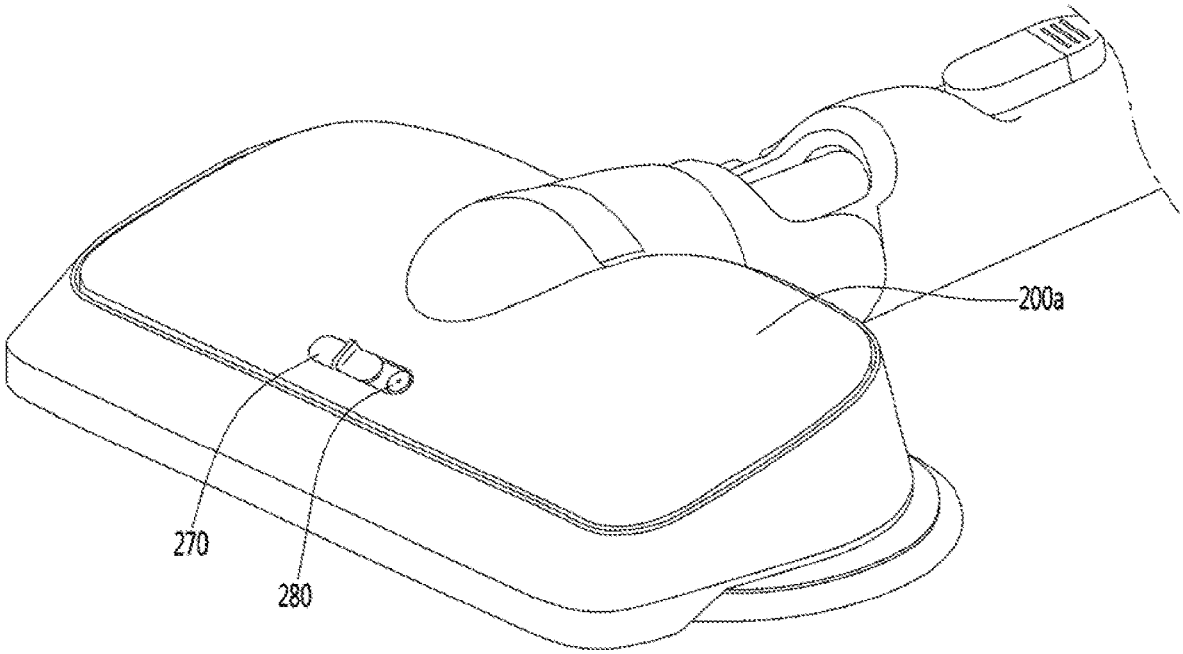
FIG. 8 is a perspective view of a nozzle for a cleaner according to a second embodiment of the present invention.
Figure 9:
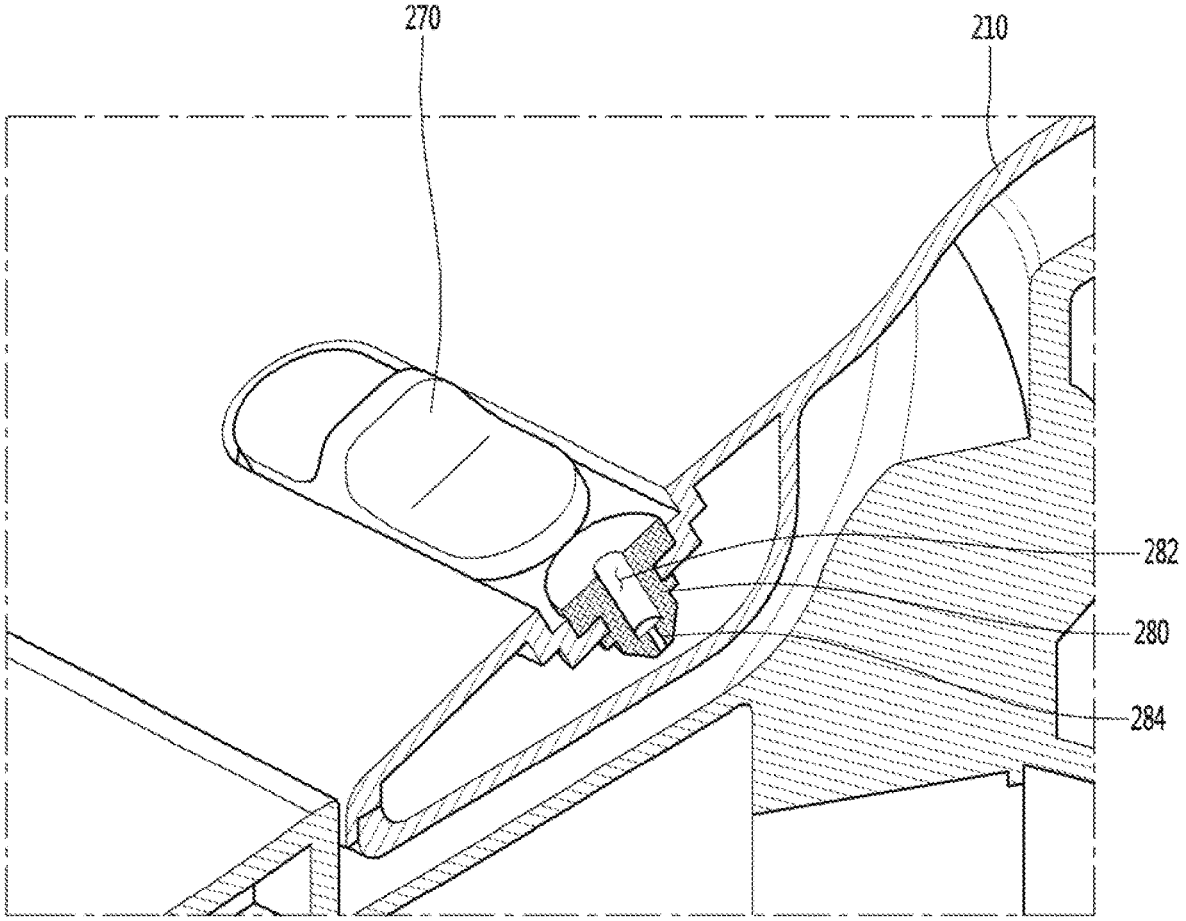
FIG. 9 is a cross-sectional view showing a gasket portion of a water tank according to the second embodiment of the present invention.

FIG. 8 is a perspective view of a nozzle for a cleaner according to a second embodiment of the present invention, and FIG. 9 is a cross-sectional view showing a gasket portion of a water tank according to the second embodiment of the present invention.

The present embodiment is equal to the first embodiment except for the structure of the water tank. Accordingly, hereinafter, only the characteristic portions of the present embodiment will be described. For the same portions as the first embodiment, refer to the first embodiment.

Referring to FIGS. 8 and 9, the water tank 200*a* according to the present embodiment may comprise an air hole operation part 270 and a gasket 280.

The gasket 280 may guide outside air into the internal space of the water tank 200*a*.

The gasket 280 may be formed of a material, the shape of which is deformed by external force. For example, the gasket 280 may be formed of a polyethylene material, without being limited thereto.

The gasket 280 may be formed in a cylindrical shape, for example, and a portion thereof may protrude from the installation part 272.

An air passage 282 in which air flows may be formed in the gasket 280 and a slit 284 may be formed in an end thereof. At this time, the end of the gasket 280 may be in contact with water in the water tank 200.

The gasket 280 may be formed such that a cross-sectional area thereof decreases from one point to the end thereof, thereby blocking the slit 284 formed in the end of the gasket 280 by the pressure of water.

According to the present embodiment, since water pressure is applied to the end of the gasket 280 to block the slit 284 in a state in which external force is not applied to the gasket 280, water of the water tank 200 is prevented from being leaked to the outside through the slit 284.

In addition, since the slit 284 is blocked by the water pressure of the water tank 200, air is not supplied into the water tank 200 through the slit 284 in a state in which external force is not applied to the gasket 280.

In order to supply water to the mops 420 and 421 before cleaning or during cleaning, it is possible to operate the air hole operation part 270.

For example, the air hole operation part 270 is moved to press the gasket 280. The gasket 280 may be deformed by pressing the gasket 280 by the pressing force of the air hole operation part 270, thereby opening the slit 274.

In a state in which the slit 274 is opened, outside air may be supplied into the water tank 200 through the slit 274. Accordingly, the slit 274 may be an air hole.

In contrast, in a state in which the slit 274 is opened, surface tension of water around the slit 274 and force of the introduced outside air become greater than the water pressure of the water tank 200 such that water is not discharged from the water tank 200 through the slit 274.

According to the present embodiment, in a state in which the air hole operation part 270 is not operated, it is possible to prevent water of the water tank 200 from being discharged to the outside through the gasket 280.

In a state of operating the air hole operation part 270, since air may be introduced into the water tank 200 through the slit 284 of the gasket 280, water may be stably supplied to the mops 420 and 421.

Figure 10:
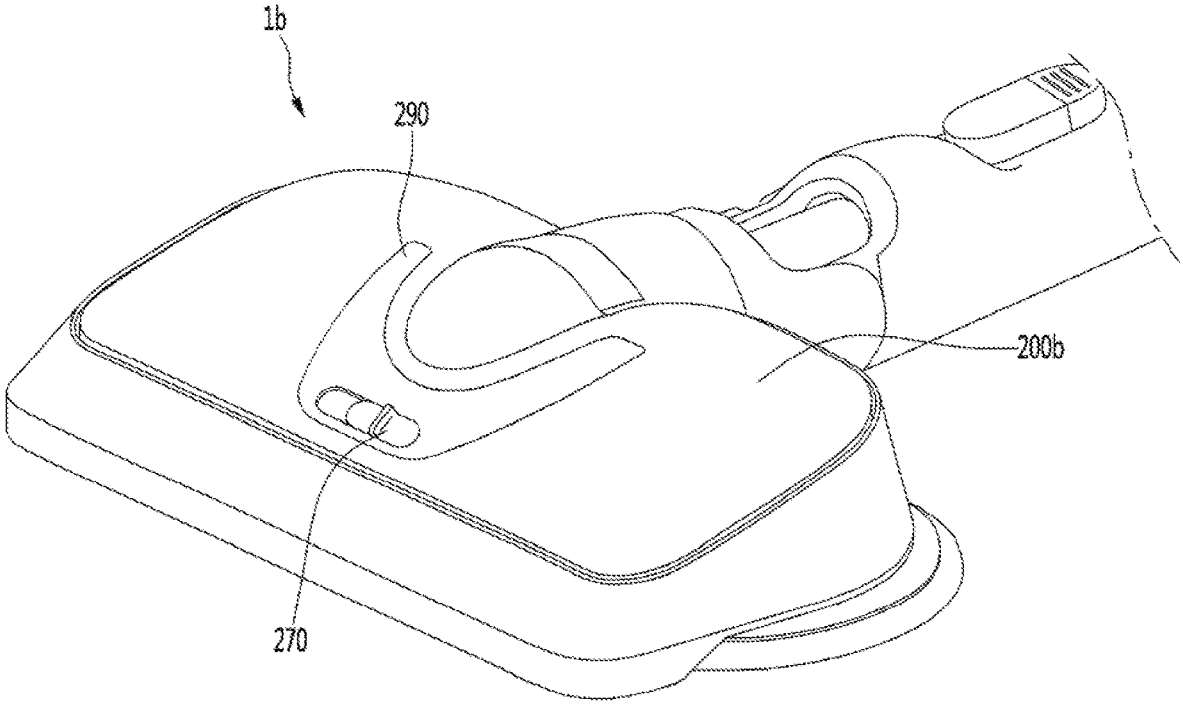
FIG. 10 is a perspective view of a nozzle according to a third embodiment of the present invention.
Figure 11:
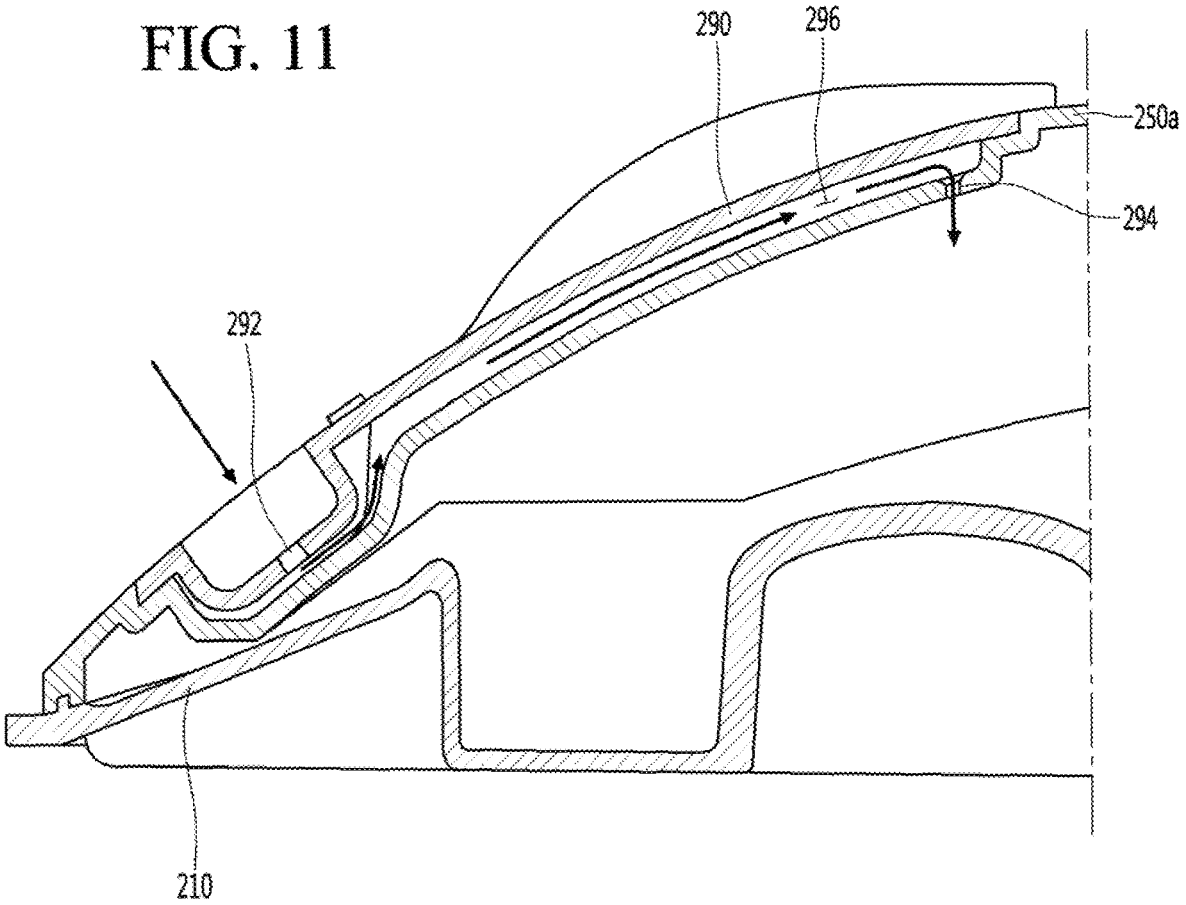
FIG. 11 is a view showing an air passage according to the third embodiment of the present invention.

FIG. 10 is a perspective view of a nozzle according to a third embodiment of the present invention, and FIG. 11 is a view showing an air passage according to the third embodiment of the present invention.

The present embodiment is equal to the first embodiment except for the structure of the water tank. Accordingly, hereinafter, only the characteristic portions of the present embodiment will be described. For the same portions as the first embodiment, refer to the first embodiment.

Referring to FIGS. 10 and 11, the nozzle 1*b* of the present embodiment may be formed such that the front side thereof is lower than the rear side thereof, in order to clean a narrow space using the nozzle 1*b*.

The water tank 200*b* according to the present embodiment may comprise an air hole operation part 270 and an air passage 296 in which air to be supplied to the water tank 200*b* flows.

The water tank 200*b* may comprise a tank body defining a chamber in which water is stored. The tank body may comprise a first body 210 and a second body 250*a* forming the chamber.

The tank body may be partially recessed in order to define the air passage 296 and the air passage 296 may be covered by a body cover 290.

For example, in FIG. 11, for example, the second body 250*a* defines the air passage 196.

The air passage 296 may extend in the forward-and-backward direction of the water tank 200*b*.

The nozzle of the present embodiment may be formed such that the front side thereof is lower than the rear side thereof, in order to clean a narrow space using the nozzle.

The air hole operation part 270 may be movably provided in the body cover 290.

In order for the user to easily recognize and operate the air hole operation part 270, the air hole operation part 270 may be located at the front side of the center of the water tank 200*b*.

A first air hole 292 for introducing air may be formed in the body cover 290. The air hole operation part 270 may open and close the first air hole 292.

When the air hole operation part 270 opens the first air hole 292, air may be introduced through the first air hole 292 and the introduced air may flow along the air passage 296.

The tank body (e.g., the second body 250*a*) may be provided with a second air hole 294 for introducing air of the air passage 296 into the water tank 200*b*.

The first air hole 292 and the second air hole 294 may be spaced apart from each other in a forward-and-backward direction.

Since the front side of the nozzle 1*b* is lower than the rear side thereof, the first air hole 292 is located at a position lower than the full water level of the water tank 200*b* by the position of the air hole operation part 270.

In contrast, the second air hole 294 may be located at a higher position than the full water level of the water tank 200*b*.

Accordingly, according to the present embodiment, even when the first air hole 292 is located at a lower position than the full water level of the water tank 200*b*, since the second air hole 294 is located at a higher position than the full water level of the water tank 200*b*, water of the water tank 200*b* may be prevented from being discharged through the second air hole 194.

According to the present embodiment, it is possible to suction in foreign materials on a floor and to rotate the mops to wipe the floor.

In particular, since the nozzle includes the water tank and water of the water tank can be continuously supplied to the mops by operating the operation part, it is possible to improve user convenience.

In addition, since the amount of water discharged from the water tank can be controlled by operating the operation part, it is possible to further improve user convenience.

In addition, by installing the gasket in the water tank, it is possible to prevent water from being leaked from the water tank to the outside when air is supplied to the water tank.

What is claimed is:

1. A nozzle for a cleaner comprising:

a nozzle body including a suction passage in which air flows;

a water tank detachably mounted on the nozzle body; and a rotation cleaning part rotatably supported at a lower side of the nozzle body, the rotation cleaning part being configured to receive water supplied from the water tank for cleaning a floor, wherein the water tank comprises:

an outlet through which water is discharged;

a valve configured to open and close the outlet;

an air hole configured to introduce outside air into the water tank; and an air hole operation part movably installed on the water tank to open and close the air hole.

2. The nozzle of claim 1, wherein the nozzle body comprises a valve operation part configured to operate the valve to open the outlet when the water tank is mounted on the nozzle body, and wherein, when the air hole is opened by operating the air hole operation part and when the valve opens the outlet, water from the water tank is discharged through the outlet.

3. The nozzle of claim 1, wherein the water tank comprises a plurality of air holes, and wherein the air hole operation part opens at least one of the plurality of air holes according to an operation position of the air hole operation part.

4. The nozzle of claim 3, wherein some of the plurality of air holes are opened when the air hole operation part is moved in a first direction and others of the plurality of air holes are opened when the air hole operation part is moved in a direction opposite to the first direction.

5. The nozzle of claim 3, wherein some of the plurality of air holes are opened when the air hole operation part is moved a first distance in a first direction and all of the plurality of air holes are opened when the air hole operation part is moved in the first direction by a second distance greater than the first distance.

6. The nozzle of claim 1, wherein the water tank comprises a plurality of air holes having different sizes, and wherein the air hole operation part selectively opens the plurality of air holes according to an operation position of the air hole operation part.

7. The nozzle of claim 1, wherein the air hole is formed in a gasket coupled with the water tank, an air passage is defined in the gasket in fluid communication with the air hole, and a portion of the gasket including the air hole is located inside the water tank.

8. The nozzle of claim 7, wherein the gasket is formed with a cross-sectional area that decreases from one point on the gasket to the portion of the gasket where the air hole is formed.

9. The nozzle of claim 7, wherein the gasket is deformable when exposed to an external force, and when an outer shape of the gasket is deformed by operation of the air hole operation part, outside air is introduced into the water tank through the air passage and the air hole.

10. The nozzle of claim 1, wherein the air hole comprises a first air hole and a second air hole formed at a higher position with respect to gravity than the first air hole, wherein the air hole operation part opens and closes the first air hole, and wherein the water tank further includes an air passage configured to enable fluid communication between the first air hole and the second air hole.

11. The nozzle of claim 10, wherein the water tank comprises a tank body that is configured to define a chamber in which water is stored, wherein the tank body defines the air passage, wherein the air passage is covered by a body cover, and wherein the first air hole is defined in the body cover and the second air hole is defined in the tank body.

12. The nozzle of claim 11, wherein the air hole operation part is installed on the body cover.

13. The nozzle of claim 11, wherein the first air hole is located at a lower position than a full water level of the water tank.

14. The nozzle of claim 11, wherein the second air hole is located at a higher position than a full water level of the water tank.

15. The nozzle of claim 11, wherein the first air hole and the second air hole are spaced apart from each other in a forward-and-backward direction relative to a front and a back of the nozzle.

* * * * *